United States Patent [19]

Dumont et al.

[11] 4,041,236

[45] Aug. 9, 1977

[54] FURNACE HAVING CERAMIC HEATING ELEMENTS

[75] Inventors: Pierre Dumont, La Celle Saint Cloud; Alain Moise, Saint Remy les Chevreuse, both of France

[73] Assignee: Commissariat a l'Energie Atomique, Paris, France

[21] Appl. No.: 674,952

[22] Filed: Apr. 8, 1976

[30] Foreign Application Priority Data

Apr. 11, 1975 France ..... 75.11335

[51] Int. Cl.[2] ..... H05B 3/10

[52] U.S. Cl. ..... 13/25; 13/20

[58] Field of Search ..... 13/25, 26, 20; 219/10.49

[56] References Cited

U.S. PATENT DOCUMENTS 3,709,998 1/1973 Anthony et al. ..... 13/25

FOREIGN PATENT DOCUMENTS 2,109,151 5/1972 France ..... 13/25

1,049,390 11/1963 United Kingdom ..... 13/25

*Primary Examiner*—R. N. Envall, Jr.

*Attorney, Agent, or Firm*—Cameron, Kerkam, Sutton, Stowell & Stowell

[57] ABSTRACT

The central cavity of the furnace is provided from the periphery to the center with a first thermal insulation, at least one element of doped lanthanum chromite, a second thermal insulation and at least one element of stabilized zirconia or thoria which permits operation of the furnace at about 2000° C.

10 Claims, 7 Drawing Figures

FURNACE HAVING CERAMIC HEATING ELEMENTS

This invention relates to a furnace equipped with ceramic heating elements which are designed to heat the furnace at a high temperature.

Furnaces are already known which are equipped with elements fabricated from oxides of lanthanides and from chromium oxides and especially from doped lanthanum chromites. These furnaces have an advantage in that they permit of satisfactory operation from room temperature but are not capable, however, of exceeding approximately 1800° C since the service life of the heating elements becomes of short duration at this temperature.

There are known refractory materials which make it possible to extend the operating range of the heating elements to temperature values higher than 1800° C. These materials are: thoria which unfortunately has the disadvantage of being radioactive, and zirconia in which electrical contacts at high temperature have a tendency to be defective and which requires preliminary heating in order to be electrically conductive.

The preheating operation is carried out in accordance with two techniques, viz:

-introduction of a heating unit in the furnace, application of voltage to the zirconia element and progressive withdrawal of the unit when the power dissipated within the zirconia is sufficient;

-heating by means of a stationary external heating coil, application of voltage to the zirconia element and progressive reduction of the power of the coil as a temperature build-up takes place within the zirconia element which finally delivers practically the full value of power.

The aim of the present invention is to provide a furnace which is not subject to the disadvantages mentioned above while being rugged, reliable, simple to use and relatively inexpensive to produce.

The invention relates to a furnace having ceramic heating elements and essentially provided within the central furnace cavity from the periphery to the center with a first thermal insulation, at least one element of lanthanide chromite, a second thermal insulation and at least one element of ceramic material which is capable of operating at approximately 2000° C.

The lanthanide chromite consists of doped lanthanum chromite and the ceramic material employed for operation at approximately 2000° C consists of stabilized zirconia or of thoria. The voltages applied to the different elements are chosen so as to ensure that, at the time of operation at the maximum temperature for which the installation is designed, the elements of lanthanum chromite do not exceed 1800° C. For example, in the case of a maximum operation temperature of the zirconia element or elements of 2200° C, the applied voltages and consequently the respective power levels are chosen so as to ensure that the elements having a lanthanum chromite base operate at a temperature which is lower by 400° C.

In the case of the maximum temperature, the zirconia element or elements thus dissipate only a portion of the total power which is lower as the thermal insulation between the two types of elements is more substantial.

The zirconia elements are each constituted by a central heating portion of stabilized zirconia which is extended at the ends thereof by portions having higher conductivity.

Depending on the form of construction, said conductive portions are of differently doped zirconia or else of lanthanum chromite having a medium value of conductivity. Finally, said portions are in turn extended by doped and highly conductive lanthanum chromite on which a metal deposit is applied at the location adopted for the electrical connections.

Further advantages and characteristics of the furnace in accordance with the invention will become apparent from the following description, reference being made therein to the acompanying drawings, in which.

Figure 1:
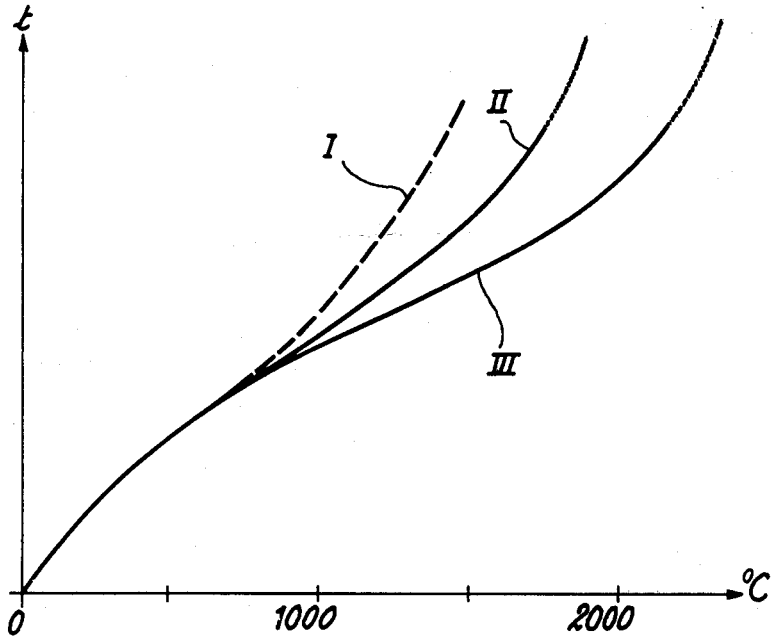
FIG. 1 shows comparative curves of variations in the temperature attained by the different elements as a function of time and in respect of a given supply power.

In FIG. 1, the curve I constitutes a characteristic corresponding to the use of lanthanum chromite elements on the assumption that provision is not made for elements of zirconia.

Curves II and III are respectively characteristics of the lanthanum chromite elements and of the zirconia elements.

The presence of the zirconia elements therefore brings about an improvement in the characteristic of the lanthanum chromite elements.

Figure 2:
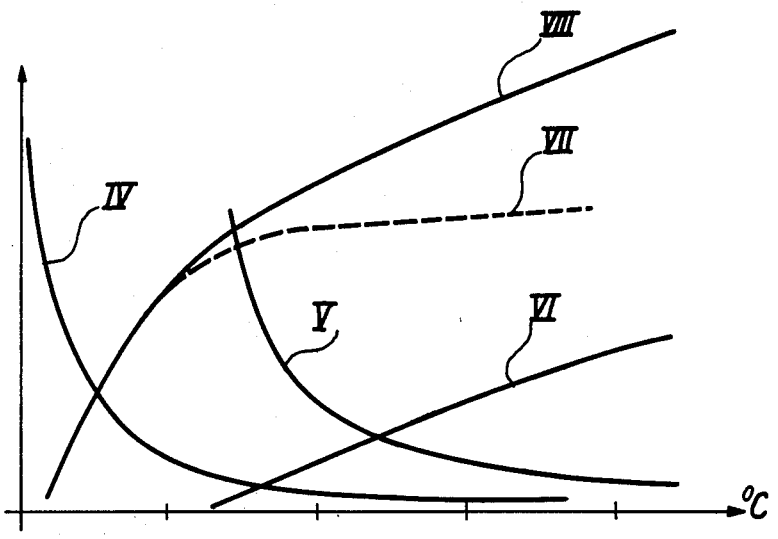
FIG. 2 shows power and resistivity curves of different elements.

In FIG. 2, curves IV and V represent respectively the variations in resistivity of the lanthanum chromite and of the zirconia. It is noted in particular that the zirconia has practically zero conductivity up to 500° C.

Curves VI, VII and VIII show respectively the variations in the power delivered by the zirconia elements and the power delivered by the lanthanum chromite elements as well as the resultant total power.

Figure 3:
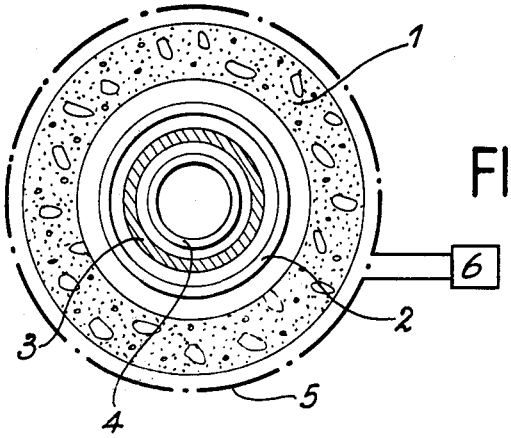
FIGS. 3 and 4 are sectional views of two embodiments of a furnace in accordance with the invention, this furnace being of tubular shape.

It is apparent from FIG. 3 that the central cavity of the tubular furnace comprises an insulating cylindrical portion of refractory brick, for example, a cylindrical element 2 of doped lanthanum chromite, an insulating portion 3 and finally a portion 4 of zirconia which surrounds the useful central portion of the furnace. A winding which is designed to heat the elements by induction is shown diagrammatically at 5.

The zirconia elements 4 are each constituted by a central heating portion 7 of stabilized zirconia which is extended at the ends thereof by portions 8 having higher conductivity.

Depending on the form of construction, said conductive portions are of differently doped zirconia 9 or else of lanthanum chromite having a medium value of conductivity. Finally, said portions are in turn extended by doped and highly conductive lanthanum chromite 11 on which a metal deposit is applied at the location adopted for the electrical connections.

The principle involved in this case is similar to the principal employed in Joule-effect heating and accordingly entails the need to ensure additional dissipation of power within the zirconia. In order to carry out such dissipation by induction, part of the electromagnet field passes through the lanthanum chromite element. The parameters of oscillation frequency, values of electrical resistivity and wall thicknesses of the lanthanum chromite and of the zirconia are chosen so as to ensure that the depth of penetration into the chromite induction element is greater than the thickness of its wall. The electromagnetic field which has passed through accordingly serves to dissipate power within the zirconia element.

Figure 4:
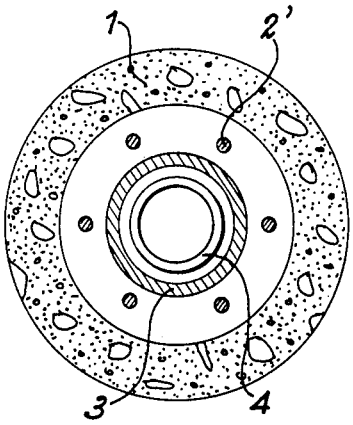

There is shown in FIG. 4 an alternative embodiment of the furnace which is very similar to the preceding form of construction except for the fact that the lanthanum chromite element 2' is no longer cylindrical but made up of a plurality of elements in the form of rods. In another alternative embodiment of a furnace, the tubular zirconia element 4 can be replaced by a plurality of elements in the form of rods.

Figure 5:
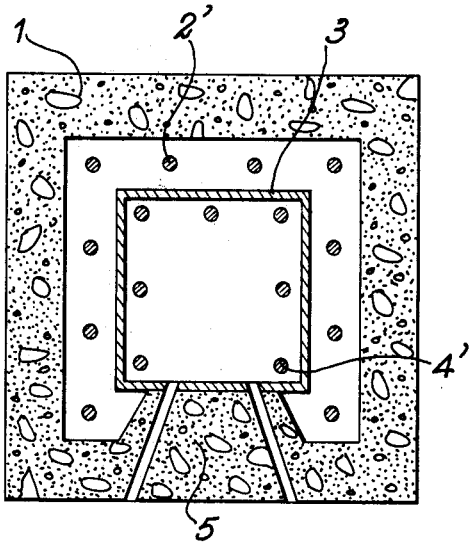
FIG. 5 is a sectional view from above showing the central cavity of a chamber-type furnace.

The central cavity of the chamber furnace shown in FIG. 5 comprises lanthanum chromite elements 2' and zirconia elements 4' which are all designed in the form of rods. Access to the interior of the central cavity is possible by virtue of the presence of a door 5.

Figure 6:
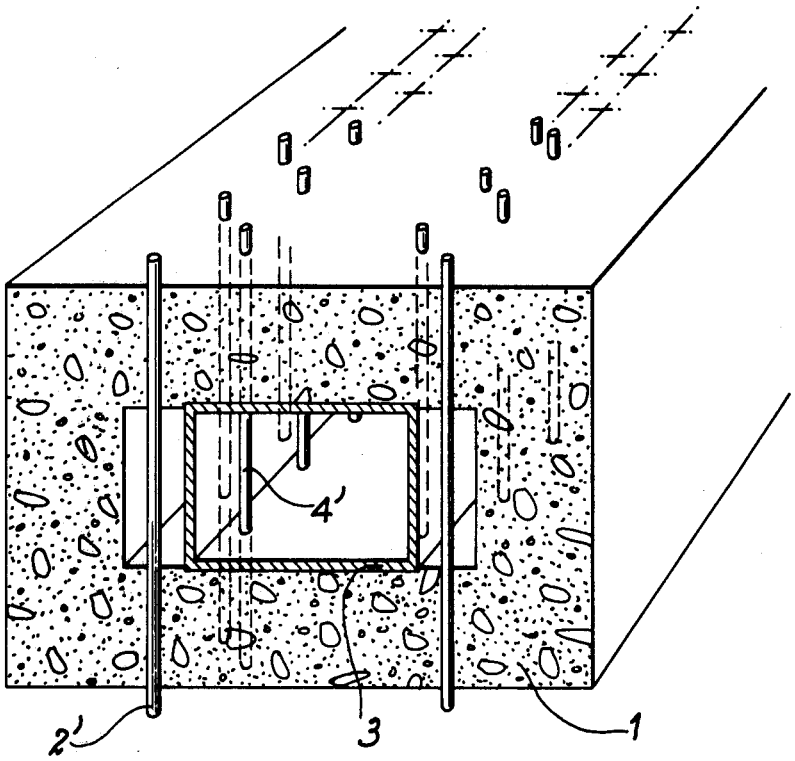
FIG. 6 shows the central cavity of a tunnel furnace.

FIG. 6 shows the arrangement of a tunnel furnace equipped with tubular elements 2' and 4' and with two insulating layers 1 and 3.

The operation of these alternative embodiments of the furnace takes place as follows.

During the initial instants of application of voltage, only the lanthanum chromite elements heat the furnace and consequently the zirconia elements. Said zirconia elements become progressively conductive as the temperature rises, thereby giving rise to superheating and the temperature of these latter exceeds that of the lanthanum chromite elements.

A regulator 6 is provided for controlling the power delivered to all the elements in order to maintain a constant internal temperature of the furnace which is equal to the established value.

It is therefore apparent that, in contrast to conventional furnaces, the furnace in accordance with the invention does not entail the need for preheating, that is, for any momentary utilization of a heating means which is withdrawn from the furnace once the zirconia elements have attained a sufficiently high temperature to be capable of beginning to produce heat themselves.

Although it may be considered that the chromite elements perform a preheating function, it should be pointed out that they remain attached to the furnace and continue to produce heat at the same time as the zirconia elements.

Moreover, only a low power input is necessary in order to maintain the zirconia elements at a temperature chosen in the vicinity of 2000°-2200° C; since the resistivity slope of zirconia is of low value at these temperatures, the result thereby achieved is to obtain stable and uniform heating at the center of the furnace.

The example given below serves to set forth the characteristics of an actual laboratory furnace as constructed in accordance with the invention.

The furnace employed comprised six rods of lanthanum chromite having an external diameter of 20 mm, a total length of 350 mm and a heating length of 100 mm, said rods being located on a circumference and surrounded by a circular thermal insulation of zirconia concrete having an external diameter of 60 mm, an internal diameter of 45 mm and a length of 100 mm.

Figure 7:
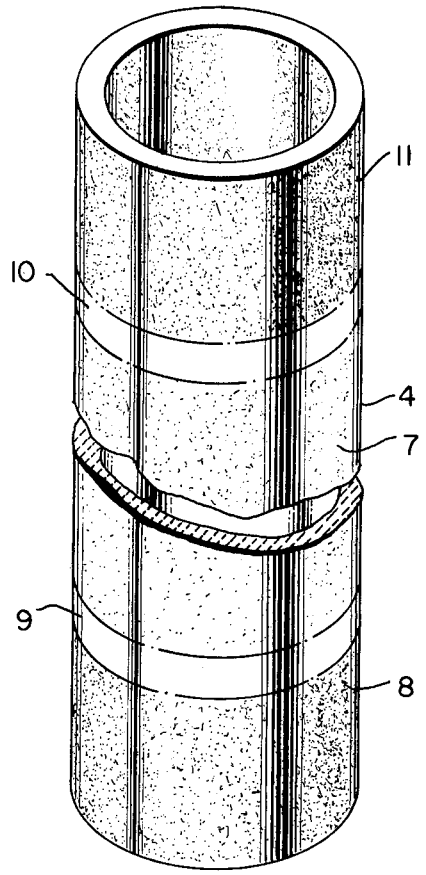
FIG. 7 is a perspective view of a ceramic element.

At the center of the furnace was housed a superheating element constituted by a central portion of zirconia stabilized with 4% CaO having an internal diameter of 32 mm and a heating length of 70 mm. Said central portion was extended at its extremities on the one hand by portions 8 of zirconia having higher conductivity (FIG. 7) and stabilized with cerium oxide $CeO_2$ and of greater thickness and on the other hand by portions 11 of doped lanthanum chromite (FIG. 7). The superheating element thus had a total length of 370 mm.

Whereas the rods connected in series were supplied at 220 volts, the superheating element was supplied at 80 volts. An optical pyrometer directed onto the superheating element actuated a regulating unit of the thyristor type.

In the case of an indicated temperature of 20250° C on the regulating unit, the behavior recorded hereunder was observed.

At the outset, only the rods produced heat since zirconia is not conductive at low temperature.

At about 1300° C, the zirconia began to be slightly conductive and the following characteristics were noted:

| | | |
|---|---|---|
| - rods | : 220V - 7.5A - 1650W - | 1340° C |
| - superheating element | : 80V - low current - | 1300° C |

The current within the zirconia increased at a uniform rate whilst the superheating element progressively became slightly hotter than the rods.

At 2000° C, the following measurements were recorded:

- rods : 220V - 8 A - 1760W - 1680° C
- superheating element : 80V - 15 A - $\frac{1200W}{2960W}$ - 2000° C At 2050° C, the thyristor-type regulator reduced the general voltage so as to maintain the temperature at a fixed value.

After stabilization, the following measurements were noted:

- rods : 175V - 6.5A - 1150W - 1780° C
- superheating element : 65V - 14.5A - $\frac{950W}{2100W}$ - 2050° C It can therefore be observed that the furnace in accordance with the invention has made it possible to produce a temperature difference between the rods and the superheating elements in a progressive and automatic manner.

It will finally be observed that the superheating element which has very high efficiency as soon as the zirconia begins to become conductive, that is to say between 1200° and 1300° C, delivers only part of the total power.

What we claim is:

1. A furnace having ceramic heating elements and essentially provided within the central furnace cavity from the periphery to the center with a first thermal insulation, at least one element of lanthanide chromite, a second thermal insulation and at least one element of ceramic material which is capable of operating at approximately 2000° C.

2. A furnace according to claim 1, wherein the lanthanide chromite employed is doped lanthanum chromite.

3. A furnace according to claim 1, wherein the ceramic material which is capable of operating at approximately 2000° C is selected from stabilized zirconia and thoria.

4. A furnace according to claim 1, wherein all the heating elements are heated electrically both continuously and simultaneously.

5. A furnace according to claim 1, wherein the heating elements are heated by induction by means of a high-frequency winding which surrounds the furnace.

6. A furnace according to claim 1, wherein the heating elements are associated with temperature regulator which controls the power delivered to said elements.

7. A furnace according to claim 1, wherein the zirconia elements are constituted by a central heating portion of stabilized zirconia which is extended at the ends thereof by portions having higher conductivity.

8. A furnace according to claim 7, wherein the ends of the central heating portion are of differently doped zirconia.

9. A furnace according to claim 7, wherein the ends of the central heating portion are of lanthanum chromite having medium value of conductivity.

10. A furnace according to claim 7, wherein said portions are extended by doped and highly conductive lanthanum chromite on which a metal deposit is applied at the location adopted for the electrical connections.

* * * * *